US006308699B1

(12) United States Patent
Schmitt

(10) Patent No.: US 6,308,699 B1
(45) Date of Patent: Oct. 30, 2001

(54) PAVING BRICK TEMPLATE

(76) Inventor: Mark R. Schmitt, 26 W. 109 Embden La., Wheaton, IL (US) 60187

( * ) Notice: Subject to any disclaimer, the term of this patent is extended or adjusted under 35 U.S.C. 154(b) by 0 days.

(21) Appl. No.: 09/433,167

(22) Filed: Nov. 3, 1999

(51) Int. Cl.[7] ..... B28D 1/00

(52) U.S. Cl. ..... 125/1; 125/12; 33/476; 33/481; 33/562

(58) Field of Search ..... 125/1, 12, 23.01, 125/35; D10/64; D19/39; D25/113; 33/518, 562, 476, 451, 481, 563, 566, 666, 669, 670

(56) References Cited

U.S. PATENT DOCUMENTS

| | | | | |
|---|---|---|---|---|
| D. 288,538 | * | 3/1987 | Cabaniss, II | D10/62 |
| D. 313,280 | | 12/1990 | Rodenburgh et al. . | |
| D. 318,813 | * | 8/1991 | Salazar et al. | D10/64 |
| 2,858,612 | * | 11/1958 | Verrett | 33/563 |
| 3,376,650 | * | 4/1968 | Cook | 33/566 |
| 3,657,824 | * | 4/1972 | Kwast | 33/174 G |
| 3,678,887 | * | 7/1972 | Smith | 118/504 |
| 3,712,825 | * | 1/1973 | Yocum | 427/264 |
| 3,834,033 | * | 9/1974 | Pinkard | 33/174 G |
| 4,670,990 | * | 6/1987 | Horvath | 33/562 |
| 5,038,714 | * | 8/1991 | Dye et al. | 118/504 |
| 5,090,129 | * | 2/1992 | Cunningham | 33/481 |
| 5,396,710 | * | 3/1995 | Battaglia | 33/429 |
| 5,447,752 | * | 9/1995 | Cobb | 427/270 |
| 5,456,015 | * | 10/1995 | Butcher et al. | 33/451 |
| 5,768,795 | * | 6/1998 | Jimenez | 33/613 |
| 5,901,445 | * | 5/1999 | Woods et al. | 29/896.6 |

FOREIGN PATENT DOCUMENTS

| | | | | |
|---|---|---|---|---|
| 2 366 137 | * | 4/1978 | (FR) | 33/563 |

OTHER PUBLICATIONS

"A Road To The Future: Tracing The History Of Concrete Pavers" by David R. Smith, Sep. 1999.

"UNILOCK® Installation Tech Guide", ©copyright Unilock 1999.

Anchor Sahara Stone® "You Can't Beat The Anchor Do–It–Yourself System", ©1997 Anchor Wall Systems, Inc., "Anchor Windsor Stone Pinless System®".

Anchor Sahara Stone® "You Can't Beat The Anchor Do–It–Yourself System", ©1997 Anchor Wall Systems, Inc., "Anchor Pinless System®".

* cited by examiner

*Primary Examiner*—Eileen P. Morgan
*Assistant Examiner*—Hadi Shakeri
(74) *Attorney, Agent, or Firm*—Trexler, Bushnell, Giangiorgi, Blackstone, & Marr, Ltd.

(57) ABSTRACT

The present invention provides a novel template which allows an installer to easily and quickly form accurate markings on a concrete brick so that the brick can be cut in a precise manner to be used in a driveway pattern, a sidewalk pattern, or the like. The template includes a frame and a planar plate. The plate has a plurality of slots formed therethrough. The template is positioned on a brick such that the plate sits on the top of the brick and the frame abuts against the sides of the brick. The installer then uses a marking tool to mark the desired cut or cuts by running the tool along the length of one slot or the slots. The template is then removed and the brick is cut accordingly.

9 Claims, 2 Drawing Sheets

PAVING BRICK TEMPLATE

BACKGROUND OF THE INVENTION

This invention is generally directed to a template which allows an installer to easily and quickly create markings on concrete paving bricks so that each concrete brick can be cut in a precise manner. In particular, the present invention provides a template which allows an installer to easily and quickly create markings on concrete paving bricks so that each concrete brick can be cut in a precise manner for use in the edge of a pattern of a driveway, walkway or the like. When the concrete paving bricks are cut in a precise manner such that the same shape results after cutting, the installer can create a much straighter border when these cut bricks are used consecutively in the border.

As a result of advances in the last twenty-five years in paving brick production, the size of bricks has become standardized with the advent of the use of concrete to form the bricks. Concrete paving bricks were introduced in the 1960s. The most common size and shape brick produced today is a rectangle twice as long as it is wide. The concrete bricks are molded or formed which allows for a consistently sized brick to be repeatedly made. This size of concrete brick can be produced with a consistency that was generally not possible with the manufacture of clay bricks.

Until approximately twenty-five years ago, clay paving bricks were the industry standard. The clay bricks tended to be irregular in size when formed as a result of the inconsistency of the clay material. The clay bricks were installed with an installation gap between the bricks that could open and close with the inconsistencies of the clay bricks. The required installation gap prevented the clay bricks from being abutted against each other to form a tight assembly. In addition, the larger installation gaps required maintenance because weeds grew between the bricks, and because a snow shovel could catch the edges of the clay paving bricks, causing damage to the clay brick or causing the clay brick to become dislodged.

The use of consistently formed concrete paving bricks has created a more exact fit in the installation thereof. The concrete bricks can be installed such that they abut against each other, thereby providing a tighter fit between the bricks, resulting in a much smaller gap between adjacent bricks than between clay bricks. As a result, concrete bricks require less maintenance than clay bricks. In addition, the consistently formed concrete bricks provide for a cleaner and more uniform look than the clay bricks.

To install a paving brick driveway, walkway or the like, installers must lay the bricks in the desired pattern; then, at the edge or border of the pattern, the installer must cut the concrete bricks into exact shapes along a drawn line, which represents he designated ending point and/or "border line" of the paved area. When the border line or cutting line is straight and drawn out (or layed out) along a point in the designed pattern that ends consistently at the ends or half-way points of the bricks, a consistent geometric shape or opening is created. The two most popular ways or designs to lay paving bricks are the "Herringbone" and "Running Bond" pattern. When the paving bricks are layed in the Herringbone pattern at this border line point, a consistent geometric triangle shape or opening is created. When the paving bricks are layed in a Running Bond pattern, where the bricks are layed at a stagger next to each other exactly half of their length, a consistent geometric half brick shaped opening is created at this border line. The installer must then cut other unlayed bricks to fill the geometric openings. The bricks are measured, marked, then cut and placed into the openings thus filling the openings and creating a straight line or border of bricks. When there is a consistent shape or opening, created by the straight line along the point in the designed pattern that ends consistently at the ends or half-way points of the bricks, the bricks, when the border is layed out in this manner, are not cut randomly, but are cut exactly and precisely to create the same shape. The more preceise the brick is cut; the straighter the border line will be. To make this precise cut, an installer must measure the brick precisely. Then, the installer must mark the brick in a way that the varying width of the marking tool's line (i.e., the thickness of the line created from a marking pencil varies from that of a "soap stone") is drawn on the brick's measurements so that a tool's line is not drawn unequally on either side of the measurement, but down the middle. After the brick is measured and marked in a precise manner, then the installer must cut the brick in a precise manner. There is a need to make the process simpler and faster.

The most common method for marking the concrete brick for cutting is for an installer to measure each brick with a tape measure or a ruler, then mark the brick and then cut the brick to the desired shape. This method can result in inaccurate cuts, and can take considerable amounts of time. When an inaccurate cut is made, the inaccurately cut brick is either thrown away or used with its imperfection, creating a less than straight edge along the border.

The present invention provides a template which allows an installer to properly mark the concrete brick—in an easy and quick manner—so that the concrete brick can then be consistently cut in a precise manner, but with a greatly reduced amount of time and a reduced amount of effort versus the prior art method. The template of the present invention can be quickly and easily positioned on the concrete brick so that the installer can mark the concrete brick. Other features and advantages will become apparent upon a reading of the attached specification in combination with a study of the drawings.

OBJECTS AND SUMMARY OF THE INVENTION

A general object of the present invention is to provide a template which allows an installer to easily and quickly create markings on concrete paving bricks so that each concrete brick can be cut in a precise manner.

An object of the present invention is to provide a template which allows an installer to mark a concrete brick for cutting that is simple and easy to use, even by an inexperienced installer, thereby saving time and effort during the paving brick installation process.

Another object of the present invention is to provide a template which can be quickly, easily and correctly positioned on the concrete brick so that an installer can mark the concrete brick.

Another object of the present invention is to provide a template which will allow an installer to mark the brick with four different marks to enable the installer to thereafter make four commonly used cuts, such that the template can be used for more than one style of brick laying.

Yet another object of the present invention is to provide a template which allows an installer to make markings on a concrete brick so that precise cuts can be made and so that the portions of the brick can be used for different parts of the pattern, thereby reducing the amount of wasted bricks.

Briefly, and in accordance with the foregoing, the present invention discloses a novel template which allows an installer to easily and quickly form markings on a concrete brick so that the brick can be cut in a precise manner. The template of the present invention can be used in a greatly reduced amount of time and in a reduced amount of effort versus the prior art method. In addition, the template is positioned on the brick accurately each time as a result of a feature of the invention.

The template includes a frame and a planar plate provided at approximately the midpoint of the frame along the depth thereof. The plate is approximately the same length and width as the concrete brick. The plate has a plurality of slots formed therethrough. Specifically, a first slot is formed at a forty-five degree angle relative to a straight side edge thereof and extends from approximately a midpoint of the straight side edge to one of the corners of the plate, a second slot is formed at a ninety degree angle relative to the straight side edge thereof, is positioned at the midpoint of the straight side edge, and extends across substantially the entire width thereof, and a third slot is formed at a one hundred and thirty five degree angle relative to the straight side edge of the plate and extends from approximately the midpoint of the straight side edge to one of the other of the corners of the plate.

In use, the template is seated on the brick such that the plate sits on the top of the brick and the inner surface of the frame abuts against the sides of the brick. The abutment of the frame with the sides of the brick prevents relative movement between the template and the brick. The installer then uses a marking tool to mark the desired cuts by running the tool along the length of the slot or slots. The template is then removed and the brick is cut along the markings by a conventional cutting tool. This provides for accurately cut bricks.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
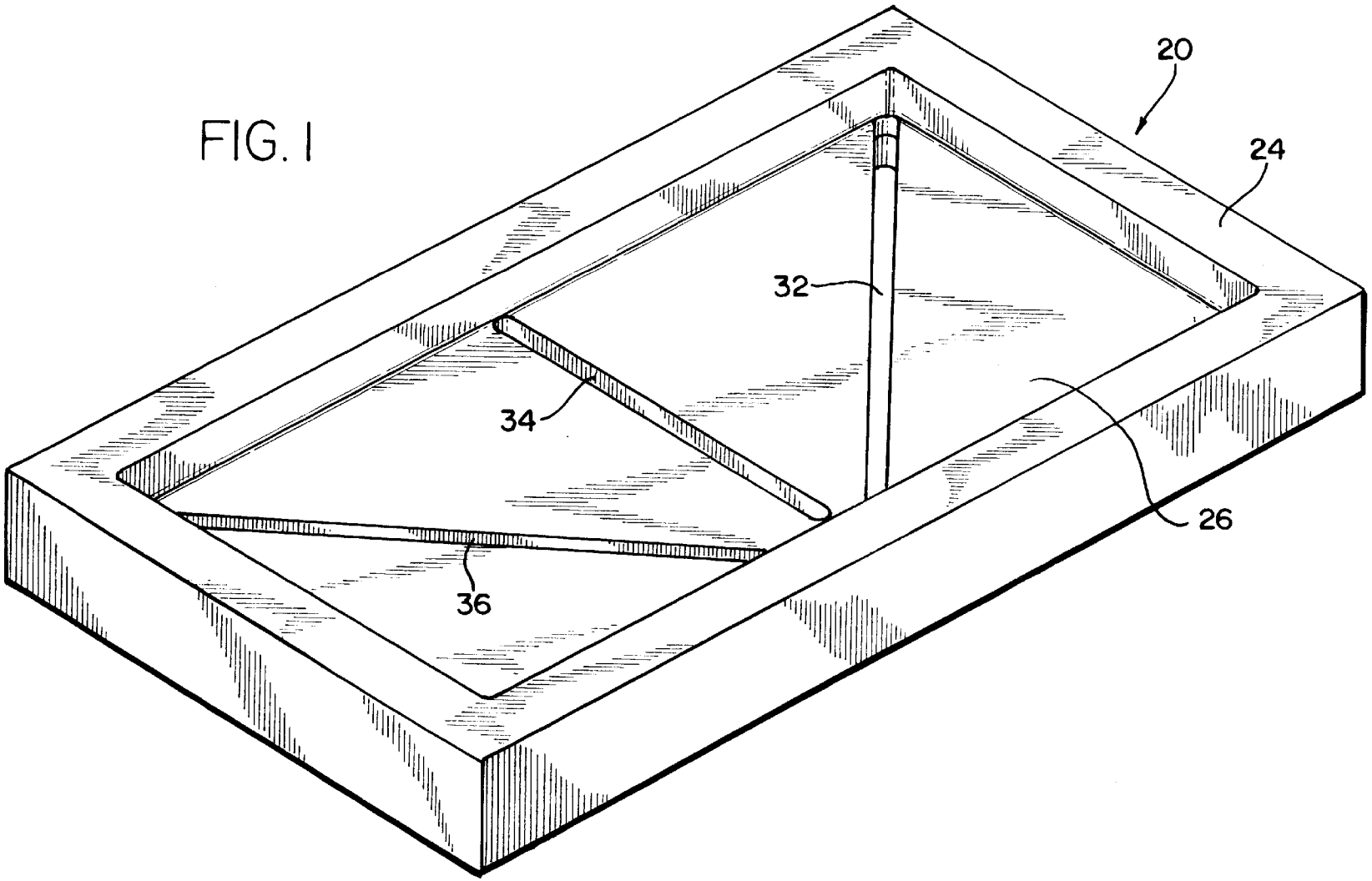
FIG. 1 is a perspective view of a template which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
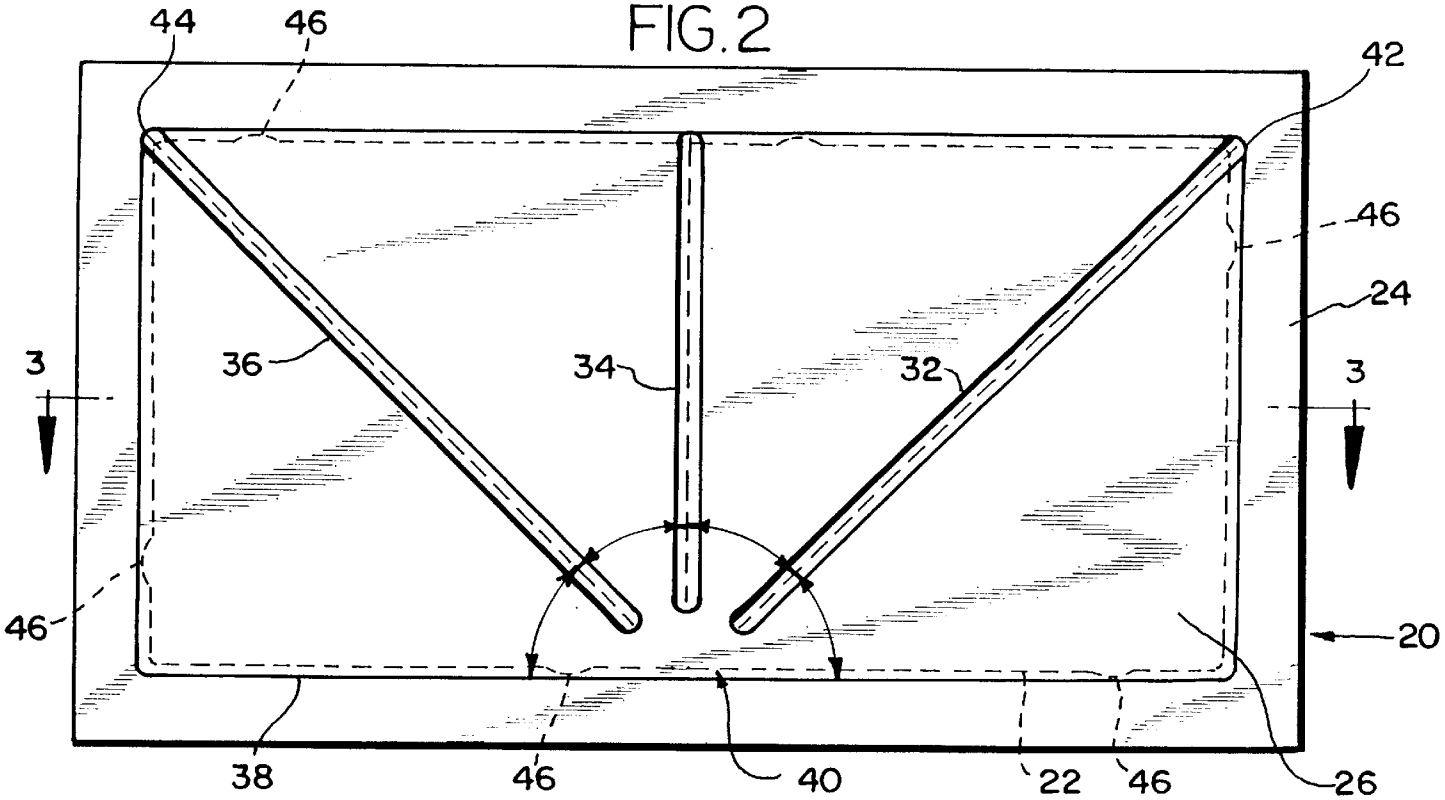
FIG. 2 is a top plan view of the template of FIG. 1.

The present invention provides a template 20 which is placed on a concrete brick 22, shown in phantom lines in FIG. 2, so that an installer can easily, quickly and accurately mark the brick 22 to indicate where the brick 22 is to be cut.

Figure 3:
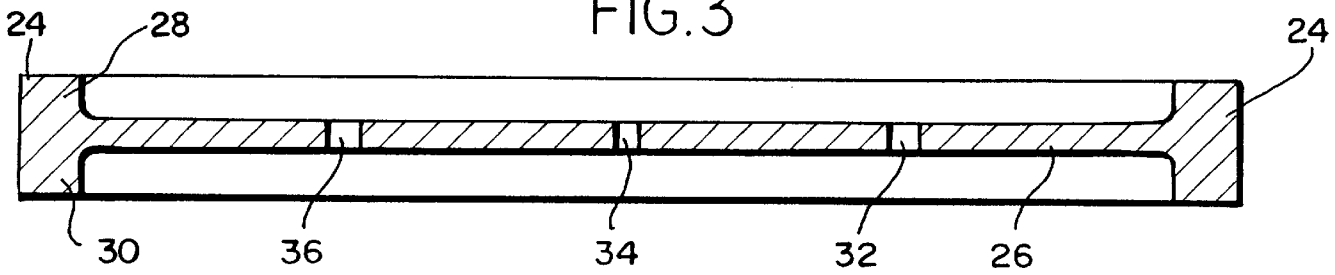
FIG. 3 is a cross-sectional view of the template along line 3—3 of FIG. 2.

The template 20 includes a rectangular frame 24 having a predetermined length, width and depth. A planar plate 26 is provided at approximately the midpoint of the depth of the rectangular frame 24 such that a first portion 28 of the frame 24 depends from one side of the planar plate 26 and a second portion 30 of the frame 24 depends from the other side of the planar plate 26, see FIG. 3. As such, the planar plate 26 has a predetermined length, width and depth. The frame 24 and the plate 26 are integrally formed by using a two part mold, and may be formed from polyvinyl chloride or other suitable moldable material. It is envisioned that metal can be used and the components can be welded or otherwise affixed together.

The plate 26 has approximately the same length and width of the concrete brick 22. The frame 24 has a predetermined length and width which is slightly greater than the length and width of the concrete brick 22. That is, if the standard concrete brick 22 is used, one that is rectangularly shaped and has a length which is twice as long as it is wide, the plate 26 is rectangularly shaped and has a length which is twice as long as it is wide. When the template 20 is seated on the brick 22, the frame 24 surrounds the upper end of the sides of the brick 22 to properly position the template 20 on the brick 22. The inner surface of the frame 24 sits snugly against the sides of the brick 22 and the plate 26 sits against the top of the brick 22. This prevents relative movement between the template 20 and the concrete brick 22. In addition, the frame 24 properly positions the template 20 on the brick 22.

In order to allow an installer to form the markings on the brick 22, the plate 22 has a plurality of slots 32, 34, 36 therethrough. The slots 32, 34, 36 through the plate 26 are provided such that the most conventional cuts can be marked on the brick 22. A first slot 32 is formed at a forty-five degree angle relative to a straight side edge 38 of the plate 26 and extends from proximate to a midpoint 40 of the straight side edge 38 to one of the corners 42 of the plate 26. A second slot 34 is formed at a ninety degree angle relative to the straight side edge 38 of the plate 26 and extends across substantially the entire width of the plate 26 from proximate to the midpoint 40 of the plate 26 to the opposite side of the plate 26. A third slot 36 is formed at a one hundred and thirty five degree angle relative to the straight side edge 38 of the plate 26 and extends from proximate to the midpoint 40 of the plate 26 to another one of the corners 44 of the plate 26. As such, the slots 32, 34, 36 are forty-five degrees apart from each other.

To use the template 20, the installer places the template 20 on the top of the brick 22, such that the plate 26 abuts the top of the brick 22 and the inner surface of one of the portions, for example, 30, of the frame 24 abuts against the sides of the brick 22. The brick 22 may have protrusions 46 against which the inner surface of the portion 30 abuts and this prevents the relative movement between the template 20 and the brick 22. The template 20 fits snugly on the brick 22. The installer then marks the brick 22 by running a marking tool along the length of one slot, for example along slot 34 to create a one-half brick, or slots, for example along all of the slots 32, 34 and 36 to form angled quarters of the brick 22, or along slots 32 and 34 to form a half brick and two quarter bricks, which indicate how the brick 22 is to be cut. The marking tool marks the lines on the brick 22 using a "sop stone ¼" or a thick "carpenters pencil". The marks can be made by scribing. As shown in the drawings, the slots are specifically designed for the soap stone's thickness. After the marks are made, the installer removes the template 20 and cuts the brick 22 using conventional cutting means.

The template 20 allows an installer to mark the brick 22 with four different marks to enable the installer to thereafter make four commonly used cuts. This allows the installer to use the template 20 for more than one style of brick laying.

The template 20 can be seated on the brick 22 such that the first portion 28 can engage the sides of the brick 22 or can be flipped over such that the second portion 30 can engage the sides of the brick 22. This allows for the installer to use both sides of the plate 26. The installer can pick up the template 20 and place the template 20 on the brick 22 without the need to make sure that one side of the template 20 is facing up.

As illustrated, the template 20 of the present invention is simple and easy to use, even by an inexperienced installer, thereby saving time and effort during the paving installation process. In addition, more precise cuts can be made, thereby allowing an installer to use portions of the brick 22 for different parts of the pattern, thereby reducing the amount of wasted bricks. Also, when the bricks 22 are cut in a precise manner such that the same shape results after cutting, the installer can create a much straighter border when these cut bricks 22 are used consecutively in the border.

While a preferred embodiment of the present invention is shown and described, it is envisioned that those skilled in the art may devise various modifications of the present invention without departing from the spirit and scope of the appended claims.

The invention claimed is:

1. A pivotless template for allowing a user to form at least one mark on a planar top of a concrete paving brick, said template comprising: a planar member which is capable of being seated upon the planar top of the concrete paving brick, said planar member having a straight side edge, said planar member having at least one slot therethrough, said at least one slot comprises a first slot, a second slot and a third slot, said first slot is formed at a forty-five degree angle relative to said straight side edge of said planar member, said second slot is formed at a ninety degree angle relative to said straight side edge of said planar member, and said third slot is formed at a one hundred and thirty five degree angle relative to said straight side edge of said planar member, and means for positioning said planar member on the planar top of the concrete paving brick, said positioning means preventing relative lateral and longitudinal movement between said planar member and the concrete paving brick.

2. A pivotless template as defined in claim 1, wherein said first slot extends from approximately a midpoint of said straight side edge to a comer of said planar member, said second slot is formed at approximately the midpoint of said straight side edge and extends across substantially the entire width of said planar member, and said third slot extends from approximately said midpoint of said straight side edge to another corner of said planar member.

3. A pivotless template for allowing a user to form at least one mark on a planar top of a concrete paving brick having a plurality of sides, said template comprising: a frame having an upper surface and a lower surface such that a predetermined depth is defined, a planar plate provided intermediate said upper and lower surfaces of said frame, said planar plate having a straight side edge, a plurality of corners, and having a length and width which are approximately the same as a length and width of the concrete paving brick, said planar plate being capable of being seated upon the planar top of the concrete paving brick such that an inner surface of said frame abuts against the plurality of sides of the concrete paving brick to prevent relative lateral and longitudinal movement between the concrete paving brick and said template, said planar plate having a first slot formed at one of a forty-five degree angle relative to said straight side edge and extending from approximately a midpoint of said straight side edge to one of said plurality of corners of said planar plate and a one hundred and thirty five degree angle relative to said straight side edge and extending from approximately said midpoint of said straight side edge to another one of said plurality of corners of said planar plate, and a second slot formed at a ninety degree angle relative to said straight side edge and extending from approximately said midpoint of said straight side edge across substantially the entire width of said planar plate.

4. A pivotless template as defined in claim 3, wherein said frame and said planar plate are formed from polyvinyl chloride.

5. A pivotless template as defined in claim 3, wherein said frame and said planar plate are integrally formed with each other.

6. A pivotless template for allowing a user to form at least one mark on a planar top of a concrete paving brick having a plurality of sides, said template comprising: a frame having an upper surface and a lower surface such that a predetermined depth is defined, a planar plate provided intermediate said upper and lower surfaces of said frame, said planar plate having a straight side edge, a plurality of corners, and having a length and width which are approximately the same as a length and width of the concrete paving brick, said planar plate being capable of being seated upon the planar top of the concrete paving brick such that an inner surface of said frame abuts against the plurality of sides of the concrete paving brick to prevent relative lateral and longitudinal movement between the concrete paving brick and said template, said planar plate having a first slot formed at a forty-five degree angle relative to said straight side edge and extending from approximately a midpoint of said straight side edge to one of said plurality of corners of said planar plate, a second slot formed at a ninety degree angle relative to said straight side edge and extending from approximately the midpoint of said straight side edge across substantially the entire width of said planar plate, and a third slot formed at a one hundred and thirty five degree angle relative to said straight side edge and extending from approximately said midpoint of said straight side edge to another one of said plurality of comers of said planar plate.

7. A pivotless template as defined in claim 6, wherein said frame and said planar plate are formed from polyvinyl chloride.

8. A pivotless template as defined in claim 6, wherein said frame and said planar plate are integrally formed with each other.

9. A pivotless template for allowing a user to form at least one mark on a planar top of a concrete paving brick, said concrete paving brick further having a planar bottom, a first side, a second side, a third side and a fourth side, said first and third sides being opposite one another, said second and fourth sides being opposite one another, said first and third sides each having a length twice as long as a length of each of said second and fourth sides, said template comprising:

a frame having an upper surface and a lower surface such that a predetermined depth of said frame is defined by said upper surface and said lower surface of said frame;

a planar plate provided intermediate said upper and lower surfaces of said frame, said planar plate having an upper surface and a lower surface such that a predetermined depth of said planar plate is defined by said upper surface and said lower surface of said planar plate, said planar plate further having on said upper surface thereof a first straight edge, a second straight edge, a third straight edge and a fourth straight edge, said first straight edge and said third straight edge being opposite one another, said second straight edge and said fourth straight edge being opposite one another, said first and third straight edges each having a length twice as long as a length of each of said second and fourth straight edges, said length of said first and third straight edges being slightly greater than said length of said first and third sides of said concrete paving brick, said length of said second and fourth straight edges being slightly greater than said length of said second and fourth sides of said concrete paving brick, said planar plate having a first corner, a second corner, a third corner and a fourth corner, said first corner being at a position where said first straight edge and said second straight edge meet, said second corner being at a position where said second straight edge and said third straight edge meet, said third corner being at a position where said third straight edge and said fourth straight edge meet and said fourth corner being at a position where said fourth straight edge and said first straight edge meet, said lower surface of said planar plate being capable of being seated upon the planar top of the concrete paving brick such that an inner surface of said frame proximate to said lower surface of said frame abuts against said first, second, third and fourth sides of the concrete paving brick to prevent relative lateral and longitudinal movement between the concrete paving brick and said template, said planar plate having first, second and third slots therethrough, said first slot being formed at a forty-five degree angle relative to said first straight side edge and extending from approximately a midpoint of said first straight side edge toward said third corner of said planar plate, said second slot being formed at a ninety degree angle relative to said first straight side edge and extending from approximately said midpoint of said first straight side edge toward a midpoint of said third straight side edge, said third slot being formed at a one hundred and thirty-five degree angle relative to said first straight side edge and extending from approximately said midpoint of said first straight side edge toward said second corner of said planar plate.

* * * * *

UNITED STATES PATENT AND TRADEMARK OFFICE

CERTIFICATE OF CORRECTION

PATENT NO. : 6,308,699 B1
DATED : October 30, 2001
INVENTOR(S) : Mark R. Schmitt It is certified that error appears in the above-identified patent and that said Letters Patent is hereby corrected as shown below:

Column 1,
Line 53, "he" should be -- the --

Column 2,
Line 8, "preceise" should be -- precise --

Column 6,
Line 38, "comers" should be -- corners --

Signed and Sealed this

Fourth Day of June, 2002

*Attest:*

*Attesting Officer*

JAMES E. ROGAN
*Director of the United States Patent and Trademark Office*